United States Patent [19]

Itakura

[11] 4,141,269

[45] Feb. 27, 1979

[54] ELECTRONIC MUSICAL INSTRUMENT

[75] Inventor: Kenji Itakura, Hamamatsu, Japan

[73] Assignee: Nippon Gakki Seizo Kabushiki Kaisha, Hamamatsu, Japan

[21] Appl. No.: 772,597

[22] Filed: Feb. 28, 1977

[30] Foreign Application Priority Data

Mar. 5, 1976 [JP] Japan ..... 51-26132[U]

[51] Int. Cl.[2] ..... G10H 1/04

[52] U.S. Cl. ..... 84/1.22; 84/1.27

[58] Field of Search ..... 84/1.01, 1.11–1.13, 84/1.19–1.24, 1.27, DIG. 9

[56] References Cited

U.S. PATENT DOCUMENTS

| | | | |
|---|---|---|---|
| 3,417,189 | 12/1968 | Kramer, Jr. | 84/1.19 |
| 3,515,039 | 6/1970 | Omura et al. | 84/1.01 |
| 3,534,144 | 10/1970 | Ring | 84/1.01 |
| 3,705,948 | 12/1971 | Tomisawa | 84/1.24 |
| 3,775,545 | 11/1973 | Tsukamoto et al. | 84/1.01 |
| 3,894,463 | 7/1975 | Rocheleau | 84/1.11 |
| 3,935,783 | 2/1976 | Machanian et al. | 84/1.21 |

*Primary Examiner*—Robert K. Schaefer
*Assistant Examiner*—Vit W. Miska
*Attorney, Agent, or Firm*—Flynn & Frishauf

[57] ABSTRACT

A plurality of tone signals corresponding to one note and having the same fundamental frequency and different harmonic components are modified in amplitude according to the shape of an envelope signal generated upon key depression and having an amplitude proportional to the key depression speed. One of the amplitude-modified tone signals is clipped at a predetermined level and then mixed with another amplitude-modified tone signal. The frequency spectrum of the resultant tone signal varies with time like a piano.

16 Claims, 4 Drawing Figures

ELECTRONIC MUSICAL INSTRUMENT

BACKGROUND OF THE INVENTION

This invention relates to an electronic musical instrument and, in particular, an electronic musical instrument arranged to simulate a struck-string instrument.

In a known electronic musical instrument arranged to simulate a struck-string instrument such as a piano, a plurality of tone signals are amplitude-modified in accordance with the shapes of different envelope signals as generated in response to the depression of one key. The amplitude-modified tone signals have their frequency spectra modified by tone coloring filters having different frequency characteristics, and the frequency spectrum-modified tone signals are mixed together. The mixed output has an amplitude proportional to a key depression speed as in the case of a struck-string instrument and has a frequency spectrum varied with time during the time interval from the build-up to the decay of the signal. Namely, in the conventional electronic musical instrument, different envelope signals are required to produce a tone signal having a frequency spectrum varied with time.

The conventional electronic musical instrument is so constructed that circuits for modifying the amplitude of tone signals are adapted to receive different envelope signals. When, therefore, amplitude modification circuits are integrated on the same semiconductor chip, the terminals of an integrated circuit package are increased in number. An arrangement in which different envelope signals are generated in response to the depression of one key is unsuitable for an integrated circuit version of an instrument. A circuit arrangement for generating a plurality of envelope signals by the depression of one key makes the construction of an electronic musical instrument complicated.

SUMMARY OF THE INVENTION

An object of this invention is to provide an electronic musical instrument which is simple in construction and which simulates a struck-string instrument.

Another object of this invention is to provide an electronic musical instrument suitable for an integrated circuit version of an instrument to simulate a struck-string instrument.

The objects of this invention are achieved by providing circuits arranged to amplitude-modify each of a plurality of tone signals corresponding to one note and having the same fundamental frequency according to the shape of an envelope signal generated upon key depression and having an amplitude proportional to the key depression speed, and a clipper for clipping off a signal portion below a predetermined level of the output signal of one of the amplitude modification circuits.

DESCRIPTION OF THE PREFERRED EMBODIMENTS

Figure 1:
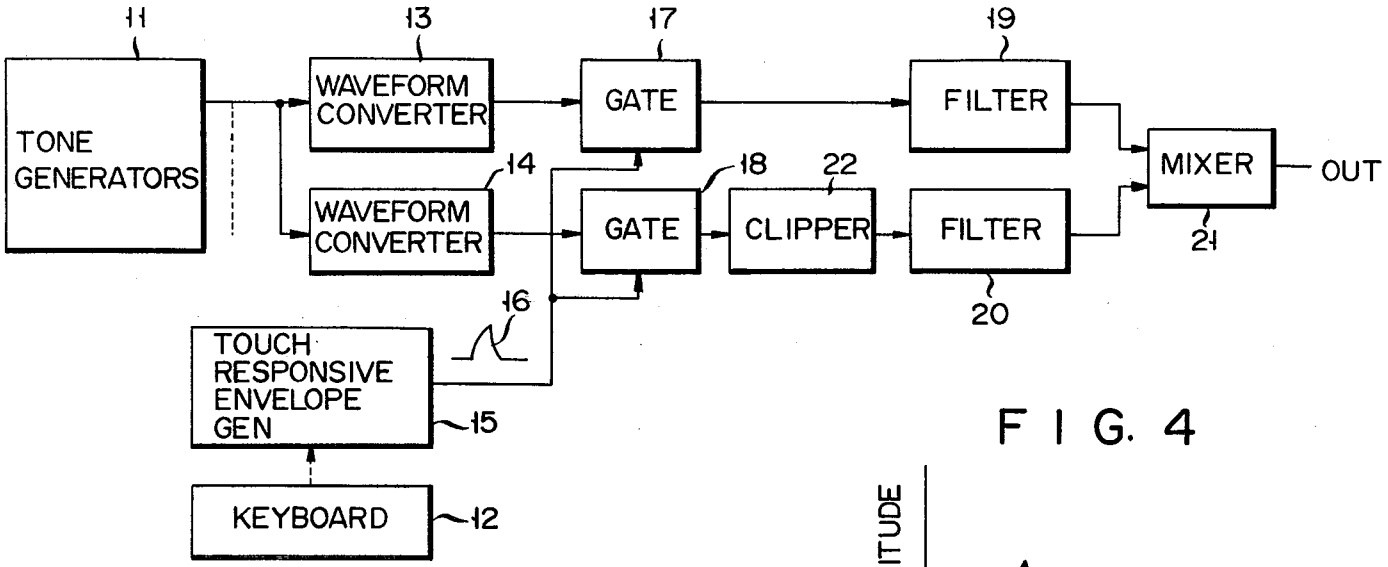
FIG. 1 shows a block diagram of an electronic musical instrument according to one embodiment of this invention.

In FIG. 1, reference numeral 11 denotes tone generators arranged to produce tone signals corresponding to the notes of keys on a keyboard 12. A tone signal corresponding to one note is applied to first and second waveform converters 13 and 14 which in turn generate respective tone signals which have the same fundamental frequency but different harmonic components.

A touch responsive envelope generator 15 is coupled to the keyboard 12 and generates a percussive-envelope signal 16 having an amplitude proportional to a key depression speed upon key depression. The envelope signal 16 is applied to first and second gate circuits 17 and 18 connected to receive output signals from the first and second waveform converters 13 and 14, respectively. The outputs of the first and second waveform converters 13 and 14 are gated with the envelope signal 16 in the first and second gate circuits 17 and 18.

The outputs of the first and second gate circuits 17 and 18 are coupled through tone coloring filters 19 and 20 to a mixer 21. The output of the mixer 21 is connected to a sound reproducing system, not shown, including an amplifier and loudspeaker. A clipper (or threshold circuit) 22 having a predetermined clipping level is connected between the second gate circuit 18 and the filter 20. The clipper 22 may be connected between the filter 20 and mixer 21. A portion above the clipping level of the output signal from the gate circuit 18 which is above the clipping level of clipper 22 is derived out from the clipper 22. As a result, two tone signals including different harmonic components are mixed in the mixer 21 at a time-varying mixing ratio during the time the envelope signal is generated. This means that the resultant tone color varies with time. The mixed output has an amplitude in proportion to the key depression speed and it is possible to electronically simulate a struck-string instrument such as a piano.

The filters 19 and 20 may have the same or different frequency characteristics. When the filters 19 and 20 have different frequency characteristics the waveform converters 13 and 14 may be omitted. In FIG. 1 is shown only a portion corresponding to one note in a polyphonic instrument. The waveform converters 13 and 14, gate circuits 17 and 18, clipper 22 and envelope generator 15 are provided at least for each note. A frequency divider chain constituting together with a clock generator the tone generators 11 and comprised of a plurality of cascade-connected flip-flop circuits, waveform converters 13 and 14, gate circuits 17 and 18, and clipper 22 can be integrated on the same semiconductor chip. The arrangement in which the same envelope signal can be supplied to the gate circuits 17 and 18 as shown in FIG. 1 is very advantageous to an integrated circuit fabrication technique.

Figure 2:
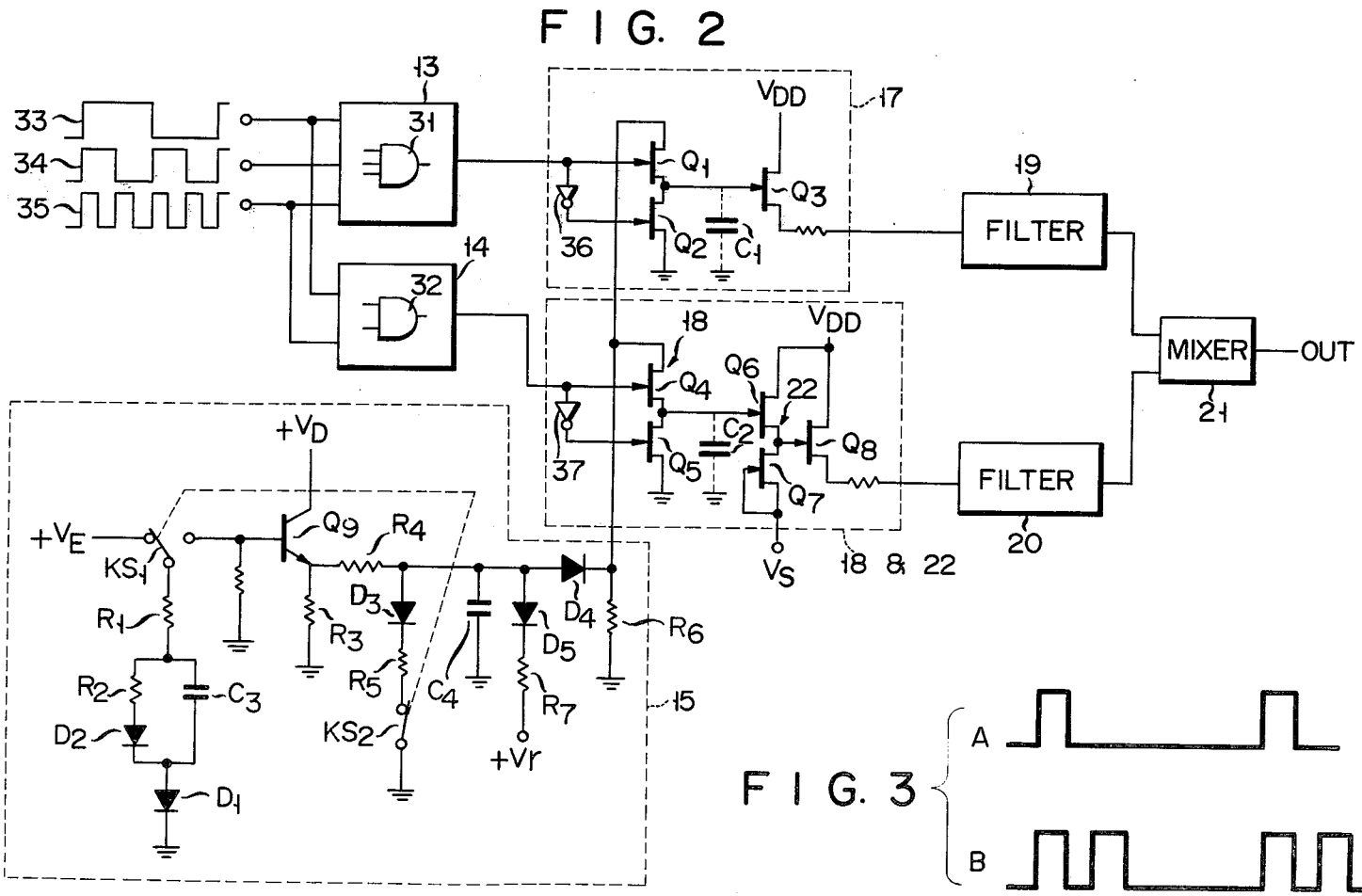
FIG. 2 shows practical circuit arrangements of several blocks of the electronic musical instrument in FIG. 1.
Figure 3:
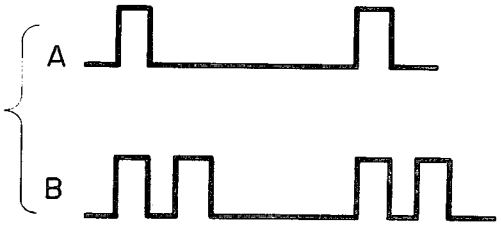
FIGS. 3A and 3B, each, show by way of example a waveform of two tone signals having the same fundamental frequency and different harmonic components.

FIG. 2 shows practical circuit arrangements for several blocks shown in FIG. 1. Circuit arrangements advantageous to integrated circuit implementation are used particularly for the gate circuits 17 and 18 and clipper 22. The waveform converter 13 is constructed of a three-input AND gate 31 and the waveform converter 14, of a two-input AND gate 32. Rectangular wave tone signals 33, 34 and 35 having a frequency ratio of 1:2:4 are supplied from the tone generators 11 to the AND gate 31, and rectangular wave tone signals 33 and 35 to the AND gate 32. In consequence, the AND gates 31 and 32 produce output tone signals as shown in FIGS. 3A and 3B, respectively. The output tone signals of the AND gates 31 and 32 have a fundamental frequency equal to the repetition frequency of the rectangular wave tone signal 33 and include different harmonic components as easily seen from FIGS. 3A and 3B.

The gate circuit 17 has field effect transistors $Q_1$ and $Q_2$ serially connected between the output of the envelope signal generator 15 and ground and arranged to be alternately turned ON and OFF by the output signal of the AND gate 31. In more detail, the output signal of the AND gate 31 is coupled directly to the gate electrode of the enhancement-type N-channel field effect transistor $Q_1$ having a drain electrode connected to the output of the envelope signal generator 15, and the output signal of the AND gate 31 is coupled through an inverter 36 to the gate electrode of the enhancement-type N-channel transistor $Q_2$ having a drain electrode connected to the source electrode of the transistor $Q_1$. It will be therefore understood that when the transistor $Q_1$ is in the ON state the transistor $Q_2$ is turned OFF and vise versa. $C_1$ represents a parasitic capacitance between ground (substrate) and the junction of the transistors $Q_1$ and $Q_2$. The capacitor $C_1$ discharges when the transistor $Q_2$ is turned ON and is charged to an envelope signal level when the transistor $Q_1$ is turned ON. That is, the envelope signal 16 is sampled during the ON time of the transistor $Q_1$ or during a pulse duration as shown in FIG. 3A. The sampled output is supplied, after amplification by an N-channel transistor $Q_3$, to the filter 19. It will be noted that, even when an output signal is supplied from the AND circuit 31, no output signal is generated from the gate circuit 17 unless an envelope signal is supplied thereto, i.e. unless the key is depressed on the keyboard 12.

The gate circuit 18 comprises an inverter 37 and enhancement type N-channel transistors $Q_4$ and $Q_5$ connected in the same manner as the transistors $Q_1$ and $Q_2$. A sampled output across a capacitor $C_2$ is coupled to the clipper 22 constituted of field effect transistors $Q_6$ and $Q_7$. In more detail, the clipper 22 comprises the enhancement-type N-channel transistor $Q_6$ having a gate electrode connected to a junction between transistors $Q_4$ and $Q_5$ and a drain electrode connected to a $V_{DD}$ terminal, the depletion-type N-channel transistor $Q_7$ having a drain electrode connected to a source electrode of the transistor $Q_6$ and source and gate electrodes connected to a clip or threshold level setting voltage source Vs. The transistor $Q_7$ in the clipper 22 operates as a constant current source. When an input signal applied to the clipper 22 becomes greater than the clip or threshold level voltage Vs, a current flows through the transistors $Q_6$ and $Q_7$, thus clipping off the signal portion of the sampled output below the clipping level Vs. A signal portion of the sampled output above the clipping or threshold level is derived out from a junction between the transistors $Q_6$ and $Q_7$ and sent through an N-channel transistor $Q_8$ for amplification to the filter 20.

The touch responsive envelope generator 15 includes a single-pole double-throw key switch $KS_I$ having a normally closed fixed contact connected to a voltage source $+V_E$ and a normally open fixed contact connected to the base of an NPN transistor $Q_9$. The pole of the key switch $KS_I$ is connected to ground through a resistor $R_1$, capacitor $C_3$ and diode $D_1$ in this order. A series circuit of a resistor $R_2$ and diode $D_2$ is connected in parallel with the capacitor $C_3$. The transistor $Q_9$ has its collector connected to a $+V_D$ terminal and its emitter connected through a resistor $R_3$ to ground. A series circuit of a resistor $R_4$ and capacitor $C_4$ is connected in parallel with the resistor $R_3$. Between ground and a junction of the resistor $R_4$ and capacitor $C_4$ are series-connected a diode $D_3$, a resistor $R_5$ and a single-pole single-throw key switch or damper switch $KS_2$ ganged with the key switch $KS_1$. A series circuit of a diode $D_4$ and resistor $R_6$ is connected in parallel with the capacitor $C_4$. A junction between the diode $D_4$ and the resistor $R_6$ is connected to the drain electrodes of the transistors $Q_1$ and $Q_4$, and a junction between the capacitor $C_4$ and the diode $D_4$ is connected through a diode $D_5$ and resistor $R_7$ to a voltage source $+V_r$.

Figure 4:
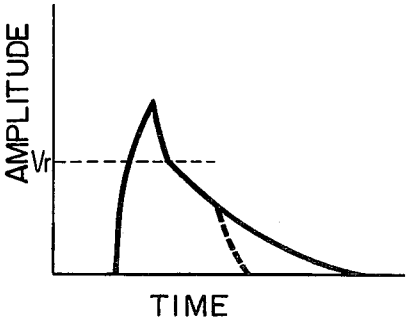
FIG. 4 shows the shape of an envelope signal.

In the above-mentioned envelope generator 15, the resistors $R_4$, $R_5$ and $R_7$ each have a relatively small value, while the resistors $R_3$ and $R_6$ each have a considerably great value. With the shown condition when a key is not depressed the capacitor $C_3$ is charged substantially to a level determined substantially by the resistors $R_1$ and $R_2$ and the capacitor $C_4$ is completely discharged. When the key is depressed, the pole of key switch $KS_1$ is switched from the normally closed contact to the normally open fixed contact and the key switch $KS_2$ is opened. In consequence, the capacitor $C_3$ begins to discharge through the resistor $R_2$. For this reason, a residual charge on the capacitor $C_3$ when the pole of switch $KS_1$ comes in contact with the normally open fixed contact is dependent upon the key depression speed or force. The transistor $Q_9$ is responsive to the residual charge applied to the base thereof to produce an output voltage across the resistor $R_3$ which is proportional to the key depression speed or force. As a result, the capacitor $C_4$ is relatively rapidly charged up to the emitter output voltage level of the transistor $Q_9$ through the resistor $R_4$. After the capacitor $C_4$ is completely charged the capacitor $C_4$ is relatively rapidly discharged to the voltage $V_r$ level through the resistor $R_7$. Thereafter, the capacitor $C_4$ is gradually discharged through the resistors $R_3$ and/or $R_6$. Accordingly, an envelope signal as shown in FIG. 4 is generated by the envelope generator 15. The key switch $KS_2$ causes the capacitor $C_4$ as indicated by a dashed line in FIG. 4 to be rapidly discharged, when a depressed key is released, thereby increasing the decay of sounding tone.

Although in FIG. 2 the gate circuits 17 and 18 are constructed of transistors of the same channel type, complementary transistors may be used and in this case no inverter is required. In the above-mentioned embodiment the clipper 22 is connected to the gate 18. However, another clipper having a clip level different from that of the clipper 22 may be connected to the output of the gate 17. It will be apparent that the invention can be applied also to a monophonic musical instrument.

What is claimed is:

1. An electronic musical instrument comprising:

a keyboard having a plurality of keys;

means for providing a plurality of tone signals corresponding to one note, each of the tone signals having a common fundamental frequency and different frequency spectra;

means coupled to said keyboard and arranged to generate an envelope signal in response to a key depression, the envelope signal having an amplitude which is a function of the key depression speed;

a plurality of envelope imparting means, each being connected to receive the envelope signal and one of the tone signals, and being arranged to impart the envelope of the envelope signal to the applied tone signal;

mixing means for mixing the output signals of said plurality of envelope imparting means; and clipping means connected between the output of at least one of said envelope imparting means and said mixing means to clip the output of said envelope imparting means.

2. An electronic musical instrument according to claim 1, in which each of said envelope imparting means includes a sampling circuit for sampling the envelope signal from said envelope signal generating means by the applied tone signal.

3. An electronic musical instrument according to claim 2, in which said sampling circuit comprises first and second field effect transistors connected between the output of said envelope signal generating means and a reference potential point and arranged to be alternately turned ON and OFF by the applied tone signal, the junction of said first and second field effect transistors being adapted to provide the sampled envelope signal.

4. An electronic musical instrument according to claim 1, in which said clipping means comprises a first field effect transistor having a drain electrode connected to a DC power supply source, a source electrode connected to the output of said clipping means and a gate electrode connected to the output of said envelope imparting means; and a second field effect transistor having a drain electrode connected to the source electrode of said first field effect transistor, a source electrode and gate electrode connected to a clipping level setting voltage source.

5. An electronic musical instrument according to claim 4, in which said second field effect transistor is of a depletion type.

6. An electronic musical instrument according to claim 1, in which said tone signals are respective rectangular wave signals having different numbers of pulses for each common period.

7. An electronic musical instrument according to claim 1, in which said means for providing a plurality of tone signals includes tone generators for generating rectangular wave tone signals and logic gates coupled to said tone generators.

8. An electronic musical instrument according to claim 1, comprising waveform converters coupled between said means for providing a plurality of tone signals and said plurality of envelope imparting means.

9. An electronic musical instrument according to claim 1, comprising filters having different frequency characteristics and coupled between said means for providing a plurality of tone signals and said mixing means.

10. An electronic musical instrument according to claim 1 wherein said envelope signal generating means generates an envelope signal having an amplitude which is proportional to the key depression speed.

11. An electronic muscial instrument according to claim 1 wherein the tone signals are rectangular wave signals having a common cyclic period and different duty cycles.

12. An electronic musical instrument comprising:

a keyboard having a plurality of keys;

means for providing a plurality of tone signals corresponding to one note;

means coupled to said keyboard and arranged to generate an envelope signal in response to a key depression, the envelope signal having an amplitude which is a function of the key depression speed;

a plurality of envelope imparting means, each being connected to receive the envelope signal and one of the tone signals, and being arranged to impart the envelope of the envelope signal to the applied tone signal, each of said envelope imparting means including a sampling circuit for sampling the envelope signal from said envelope signal generating means by the applied tone signal;

mixing means for mixing the output signals of said plurality of envelope imparting means;

means for making, before said mixing, said plurality of tone signals to have different harmonic components; and clipping means connected between the output of at least one of said envelope imparting means and said mixing means to clip the output signal of said envelope imparting means.

13. An electronic musical instrument according to claim 12, in which said sampling circuit comprises first and second field effect transistors connected between the output of said envelope signal generating means and a reference potential point and arranged to be alternately turned ON and OFF by the applied tone signal, the junction of said first and second field effect transistors being adapted to provide the sampled envelope signal.

14. An electronic musical instrument according to claim 12 wherein said envelope signal generating means generates an envelope signal having an amplitude which is proportional to the key depression speed.

15. An electronic musical instrument according to claim 12 wherein the tone signals each have a common fundamental frequency and different frequency spectra.

16. An electronic musical instrument according to claim 12 wherein the tone signals are rectangular wave signals having a common cyclic period and different duty cycles.

* * * * *